United States Patent [19]

Sapp

[11] Patent Number: 4,934,390

[45] Date of Patent: Jun. 19, 1990

[54] METHODS AND APPARATUS FOR CLEANING REFRIGERATION EQUIPMENT

[75] Inventor: Jesse M. Sapp, Louisville, Ga.

[73] Assignee: Thermo King Corporation, Minneapolis, Minn.

[21] Appl. No.: 286,103

[22] Filed: Dec. 15, 1988

[51] Int. Cl.[5] ..... B08B 9/00

[52] U.S. Cl. ..... 134/22.18; 134/22.12; 134/22.14; 134/22.19; 62/77; 62/303

[58] Field of Search ..... 62/303, 298, 77; 134/21, 22.12, 22.14, 22.18, 22.19

[56] References Cited

U.S. PATENT DOCUMENTS

| | | | |
|---|---|---|---|
| 2,341,429 | 2/1944 | Elsey | 62/170 |
| 2,341,430 | 2/1944 | Elsey | 62/170 |
| 3,232,070 | 2/1966 | Sparano | 62/149 |
| 4,261,178 | 4/1981 | Cain . | |
| 4,363,222 | 12/1982 | Cain . | |
| 4,367,637 | 1/1983 | Paulokat . | |
| 4,441,330 | 4/1984 | Lower | 62/149 |
| 4,470,265 | 9/1984 | Correia . | |
| 4,476,688 | 10/1984 | Goddard | 62/149 |
| 4,513,578 | 4/1985 | Proctor et al. . | |
| 4,539,817 | 9/1985 | Staggs | 62/149 |
| 4,554,792 | 11/1985 | Margulefsky | 62/77 |
| 4,624,112 | 11/1986 | Proctor . | |
| 4,646,527 | 3/1987 | Taylor | 62/85 |
| 4,688,388 | 8/1987 | Lower et al. . | |
| 4,766,733 | 8/1988 | Scuderi | 62/77 |
| 4,776,174 | 10/1988 | Rich | 62/77 |

*Primary Examiner*—Asok Pal
*Assistant Examiner*—Ourmazd S. Ojan
*Attorney, Agent, or Firm*—D. R. Lackey

[57] ABSTRACT

Methods and apparatus for cleaning refrigeration equipment by flushing all refrigerant paths with high pressure refrigerant, following an initial evacuation to prevent air contamination of the refrigerant. Highly effective leak tests may be simultaneously performed. A pump down procedure at the termination of the cleaning process returns all refrigerant to a first tank of the cleaning apparatus, and a contaminant removal procedure removes contaminants from the refrigerant in a second tank.

10 Claims, 4 Drawing Sheets

70

METHODS AND APPARATUS FOR CLEANING REFRIGERATION EQUIPMENT

TECHNICAL FIELD

The invention relates to refrigeration equipment, and more specifically to methods and apparatus for cleaning and facilitating the testing of refrigeration equipment.

BACKGROUND ART

The manufacture of refrigeration equipment, including evaporator coils, condenser coils, and refrigeration units which include such coils, are all cleaned, degreased, and tested at many different manufacturing stages, as well as after the refrigeration unit is completed. Leak tests and vapor de-greasing often utilize refrigerants and solvents which may be environmentally harmful, and thus costly steps must be taken to prevent release of potentially harmful vapors to the atmosphere. The tests of completed refrigeration units, such as transport refrigeration units, are time consuming because each tester requires two test cells, one for running a unit with a suction filter preparatory to test, and the other for performing the tests. Set up time is lengthy because filters on the unit must be removed and replaced by new ones after the test, as the initial filters may be immediately contaminated by particles in the refrigerant circuit produced during manufacture. Leak tests are usually conducted with refrigerant and nitrogen without evacuating the unit. Evacuating the unit after test to remove moisture prior to charging the equipment with refrigerant is a relatively lengthy process. It would be desirable, and it is the object of the present invention, to provide new and improved methods and apparatus for facilitating the manufacture and testing of refrigeration equipment, while substantially eliminating the release of solvent vapors and refrigerants to the atmosphere.

SUMMARY OF THE INVENTION

Briefly, the present invention includes methods and apparatus for cleaning refrigeration equipment which eliminate the need for vapor de-greasing, and which flushes all paths of refrigeration equipment with high pressure refrigerant enabling effective leak tests to be performed during the cleaning cycle.

The apparatus includes a vacuum circuit and a refrigerant circuit to which the equipment to be cleaned is automatically and sequentially connected. The vacuum circuit includes a vacuum pump and appropriate solenoid valves. The refrigerant circuit, in addition to appropriate solenoid valves, includes a compressor, a condenser, a first tank containing high pressure liquid refrigerant, a second tank for separating contaminants from the refrigerant, and also for vaporizing refrigerant prior to introducing refrigerant to the suction port of the compressor, and filters and driers which remove moisture and contaminants not removed in the second tank. Following the cleaning operation, a pump down cycle removes all refrigerant from the unit being cleaned and returns it to the first tank of the cleaning apparatus, all without releasing refrigerant to the atmosphere.

The leak tests, performed while pure refrigerant is circulating through the refrigeration unit under high pressure, may be performed by refrigerant leak detectors, which greatly increases the reliability of such tests. Refrigerant leak detectors are effective because the surrounding air is free of trace refrigerant due to the refrigerant recovery process without atmosphere release. Since the units are cleaned prior to final test, they are devoid of particulate contaminants. Thus, the filters of the unit being tested do not have to be removed and discarded after test. Also, since most moisture is removed from the unit during the cleaning operation, the time required to evacuate a unit preparatory to charging with refrigerant is reduced by over 50%. Each tester requires only one test box, as the unit can be immediately tested, without first operating the unit with a suction filter. Thus, the overall time to test a unit is reduced while increasing the efficacy of the tests, all without requiring vapor de-greasing and without release of refrigerants to the atmosphere.

BRIEF DESCRIPTION OF THE DRAWINGS

The invention may be better understood and further advantages and uses thereof more readily apparent when considered in view of the following detailed description of exemplary embodiments, taken with the accompanying drawings, in which.

DESCRIPTION OF PREFERRED EMBODIMENTS

Figure 1:
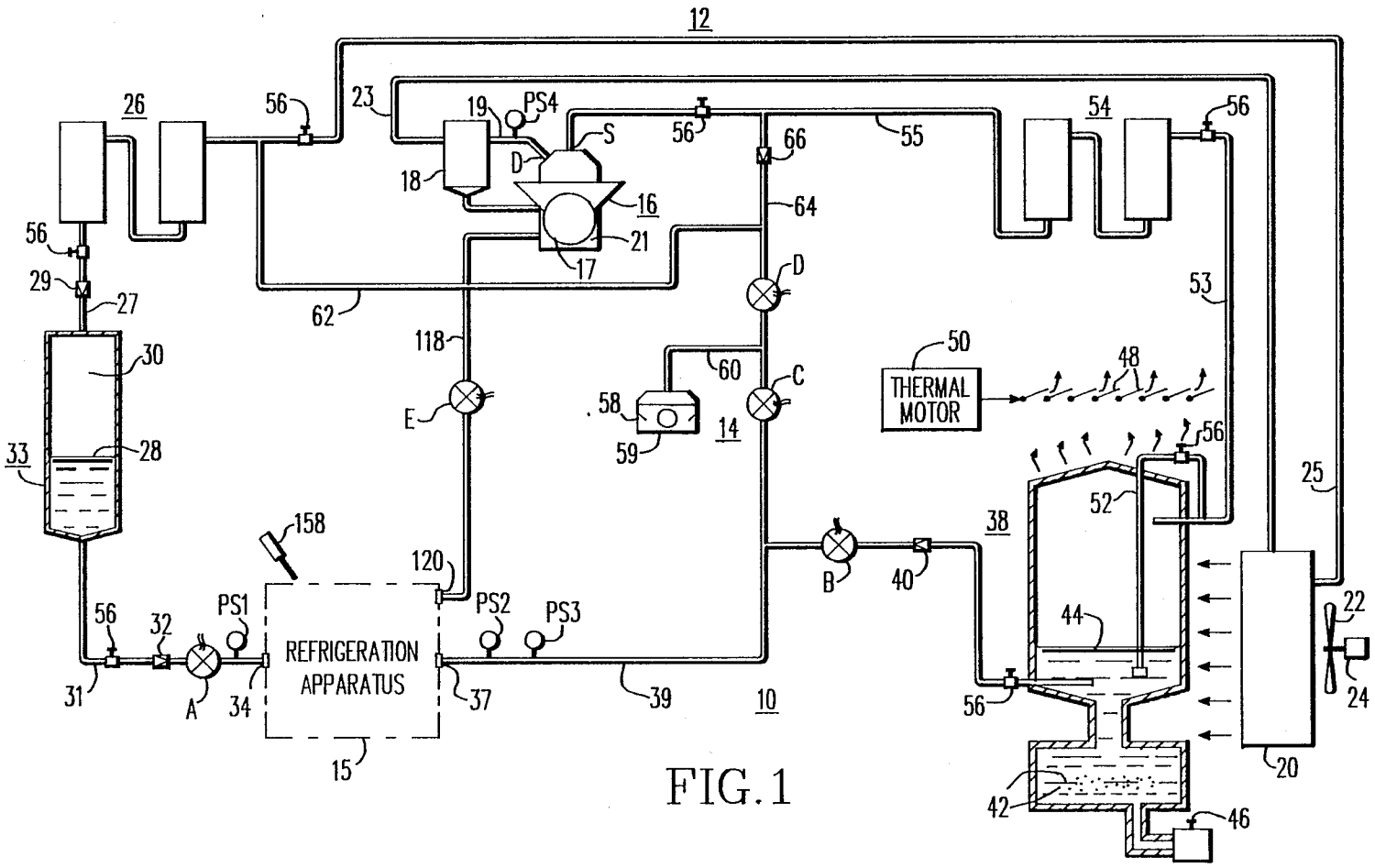
FIG. 1 is a piping diagram of cleaning apparatus constructed according to the teachings of the invention.

Referring now to the drawings, and to FIG. 1 in particular, there is shown cleaning apparatus 10 constructed according to the teachings of the invention. Cleaning apparatus 10 includes a refrigerant circuit 12 and a vacuum circuit 14, both of which are selectively connected to refrigeration equipment 15 to be cleaned.

The refrigerant circuit 12 includes a compressor 16 having discharge and suction ports D and S, respectively, driven by a suitable prime mover, such as an electric motor 17. The refrigerant circuit 12 continues, starting at the discharge port D of compressor 16, with a refrigerant conduit or line 19 which includes a pressure switch PS4 which measures the head pressure of compressor 16. Line 19 is connected to an oil separator 18 which removes compressor oil from hot, high pressure refrigerant vapor discharged from compressor 16 and returns it to the compressor oil sump 21. The hot, high pressure refrigerant vapor is then directed to a condenser 20 via a line 23, where it is condensed to a high pressure liquid. Condenser 20 includes a condenser fan 22 driven by an electric motor 24.

Liquid refrigerant from condenser 20 is then directed to drier filters 26 via a line 25 where moisture is removed from the liquid refrigerant. The liquid refrigerant then flows to a tank 33 via a line 27 which includes a check valve 29, where it is stored under high pressure. High pressure refrigerant vapor 30 occupies the space above the level of the liquid refrigerant 28 in tank 33.

Tank 33 is connected to the refrigeration equipment 15 to be cleaned via a line 31 which includes a check valve 32, a normally closed solenoid valve A, and a pressure switch PS1, with the connection to equipment 15 from line 31 being indicated at 34. The refrigerant circuit 12 thus includes the refrigeration apparatus or equipment 15 to be cleaned. Circuit 12 then continues from apparatus 15 to a tank 38 via a second connection 37 to apparatus 15, and a line 39 which includes pressure switches PS2 and PS3, a normally closed solenoid valve B, and a check valve 40.

The refrigerant entering tank 38 from apparatus 15 is in the form of high and low pressure liquid, and it contains any particulate matter or contaminants 42 which may have been picked up during the high pressure flushing of apparatus 15.

Tank 38 functions to separate the contaminants 42 from the refrigerant by passing the liquid refrigerant through compressor oil 44. Tank 38 is designed such that the contaminants 42 gravitate to the bottom of the tank, through the compressor oil 44, where they may be periodically removed via a hand valve 46.

Tank 38 also functions to vaporize the refrigerant introduced into the compressor oil 44 by heating the tank 38. According to the teachings of the invention, the heat source is condenser 20, with the tank 38 and condenser 20 being in a common enclosure which allows heat removed from condenser 20 to be absorbed by the liquid refrigerant, producing a rapid boil off of the refrigerant and vapor for compressor 16. The temperature of tank 38 is regulated by shutters 48 disposed above tank 38 and condenser 20, and a thermal or wax motor 50 which is linked to shutters 48 via a suitable mechanism. A pick up tube 52 in tank 38 may be used to adjust the level of compressor oil, if necessary.

The vaporized refrigerant is drawn from tank 38 to the suction port S of compressor 16 via a line 53 connected to drier filters 54, and a line 55 which extends from the drier filters 52 to compressor 16. The refrigerant flow cycle through the refrigerant circuit 12 then continuously repeats for a predetermined period of time, as will be hereinafter described.

A plurality of hand valves 56 are appropriately located about refrigeration circuit 12, for maintenance purposes.

The vacuum circuit 14 includes a vacuum pump 58 driven by a motor 59. Vacuum pump 58 is connected to line 39 via a line 60 which includes a normally closed solenoid valve C. For pumping the system down after drier cartridges are periodically removed from the filter driers 26 and 54, the vacuum circuit 14 may also extend to discharge drier filters 26 via a line 62 which includes a normally closed solenoid valve D, and to suction drier filters 54 from line 62 to line 55 via a line 64 which includes a check valve 66.

Cleaning apparatus 10 may be used for cleaning components of a refrigeration unit before assembly thereof into a refrigeration unit, such as evaporator and condenser coils. This is desirable since cleaning apparatus 10 permits such intermediate cleaning and leak testing of refrigeration components to be made without requiring a vapor de-greaser, and without releasing refrigerants to the atmosphere. Cleaning apparatus 10 will be described, however, relative to the cleaning and leak testing of a refrigeration unit, as it will be obvious from the description how the cleaning apparatus may be used to clean components, such as evaporator and condenser coils.

Figure 2:
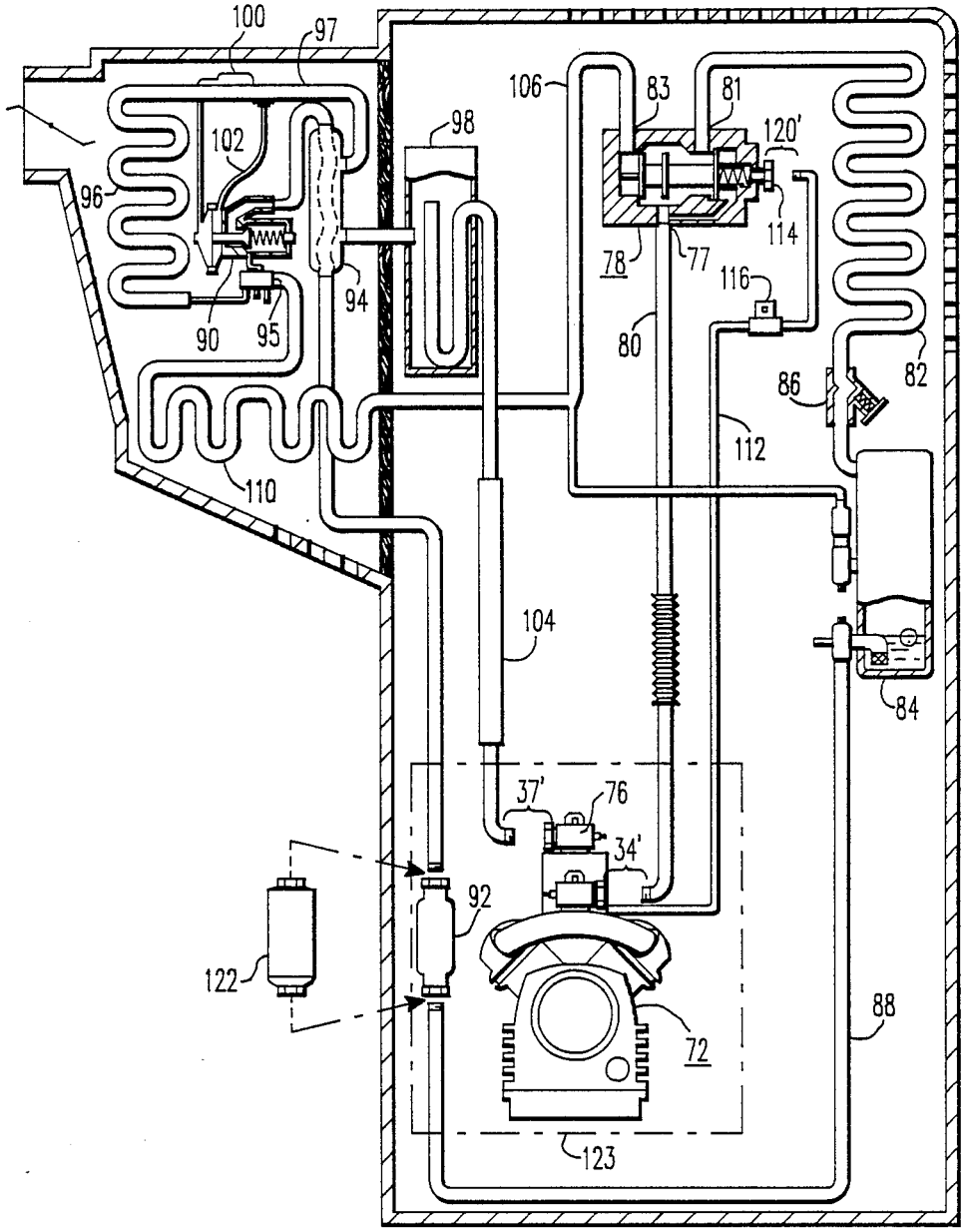
FIG. 2 is a piping diagram of a transport refrigeration unit which may be cleaned and tested according to the teachings of the invention, illustrating; (1) disconnection of the unit's compressor so that the cleaning apparatus shown in FIG. 1 may be connected into the refrigeration circuit of the unit in place of the compressor; (2) a connection to a three-way valve used by the unit to select heating and cooling modes; and (3) a temporary replacement of the unit's drier with a strainer.

FIG. 2 is a piping diagram of a transport refrigeration unit 70 which may be cleaned and leak tested according to the teachings of the invention. Refrigeration unit 70 includes a compressor 72 having a discharge service valve 74 and a suction service valve 76. Discharge service valve 74 is connected to the input 77 of a three-way valve 78 via a hot gas line 80. One output 81 of three-way valve 78, which output is used to place the unit in a cooling mode, is connected to a condenser 82, with condensed refrigerant being directed from condenser 82 to a receiver 84 via a check valve 86. A liquid line 88 runs from receiver 84 to an expansion valve 90 via a drier 92 and a heat exchanger 94. Expansion valve 90 is connected to the input or distributor 95 of an evaporator coil 96, and the output 97 of evaporator coil 96 is connected to an accumulator 98 via the heat exchanger 94. Expansion valve 90 is controlled via a feeler bulb 100 and an equalizer line 102, associated with the output of evaporator coil 96. Accumulator 98 is connected to the suction service valve 76 via a suction line 104.

The remaining output 83 of three-way valve 78, which output is used to place unit 70 in a heating mode, is connected to the input 95 of evaporator 96, by-passing expansion valve 90, via a line 106 which extends from three-way valve 78 to input distributor 95, via a defrost pan heater 110.

The position of three-way valve 78 is controlled by a line 112 which extends from the suction side of compressor 72 to a control inlet 114 of three-way valve 78 via a normally closed pilot solenoid valve 115. When pilot solenoid valve 116 is closed, valve 78 is biased to the cooling mode position, and when pilot solenoid valve 116 is energized to open line 112, the compressor pressure biases three-way valve 78 to the heating position.

To clean refrigeration unit 70, compressor 72 is disconnected from the remaining portion of unit 70, disconnecting hot gas line 80 from the discharge service valve 74, as indicated at 34', disconnecting suction line 104 from the suction service valve 76, as indicated at 37', and disconnecting line 112 from input 114 of three-way valve 78, as indicated at 120'. Connector 34 of cleaning apparatus 10 is connected to the hot gas line 80 which would normally be connected to the discharge service valve 74, connector 37 is connected to the suction line 104, and a line 118 of cleaning apparatus 10 is connected to input 114 of three-way valve 78 via a connector 120. Line 118 runs to compressor 16 via a solenoid valve E, which valve functions the same as pilot solenoid valve 116 of unit 70. To complete the set-up procedure, drier 92 is removed and replaced by an 80 mesh monel strainer 122 which prevents large particulate matter from entering expansion valve 90, and the feeler bulb 100 is removed from the outlet conduit 97 of evaporator coil 96. Thus, the portion of unit 70 shown within broken outline 123 is removed or disconnected, during the cleaning and testing procedure of the invention.

Figure 3:
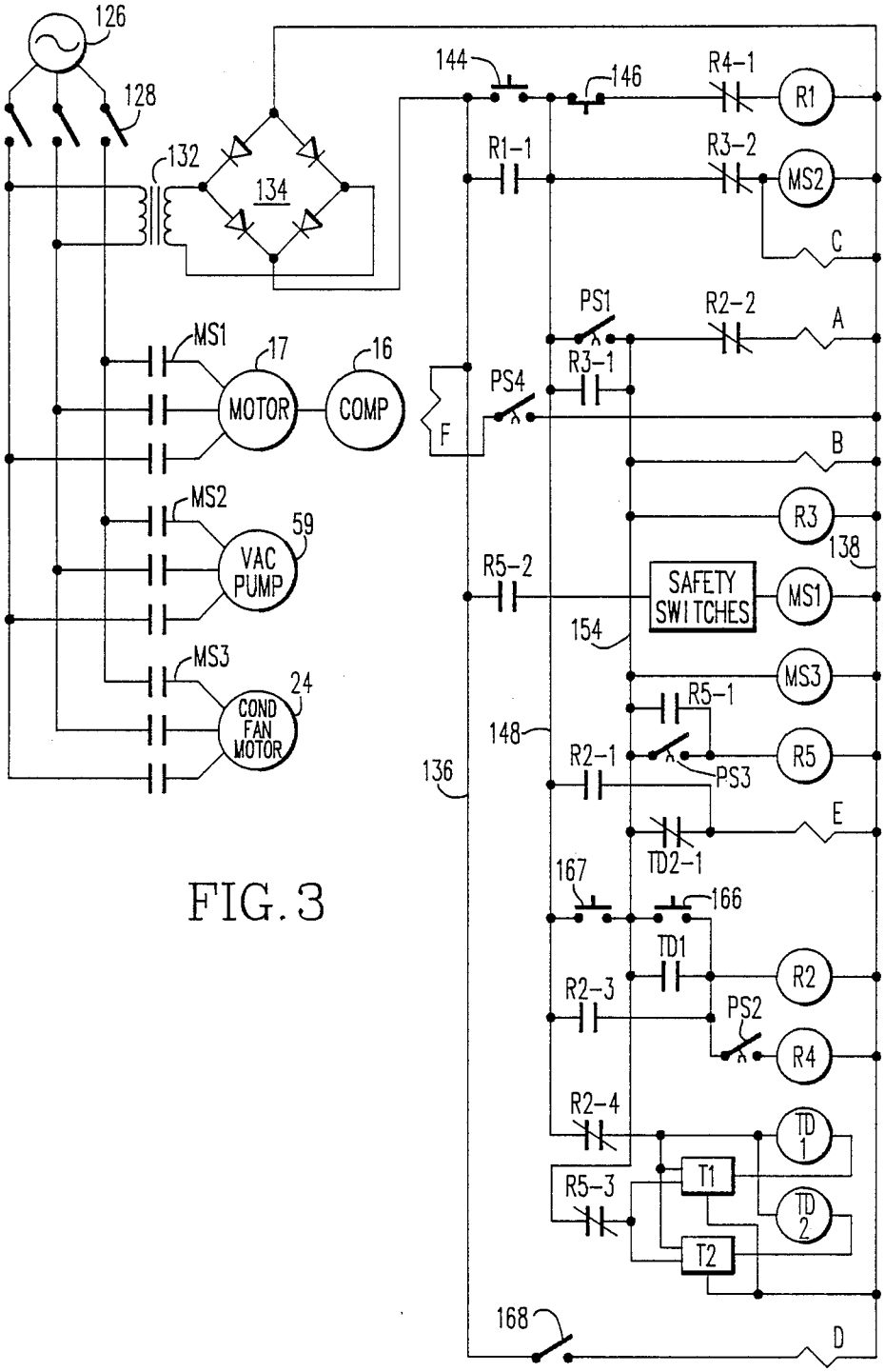
FIG. 3 is an electrical schematic illustrating control circuitry utilized by the cleaning apparatus shown in FIG. 1.
Figure 4:
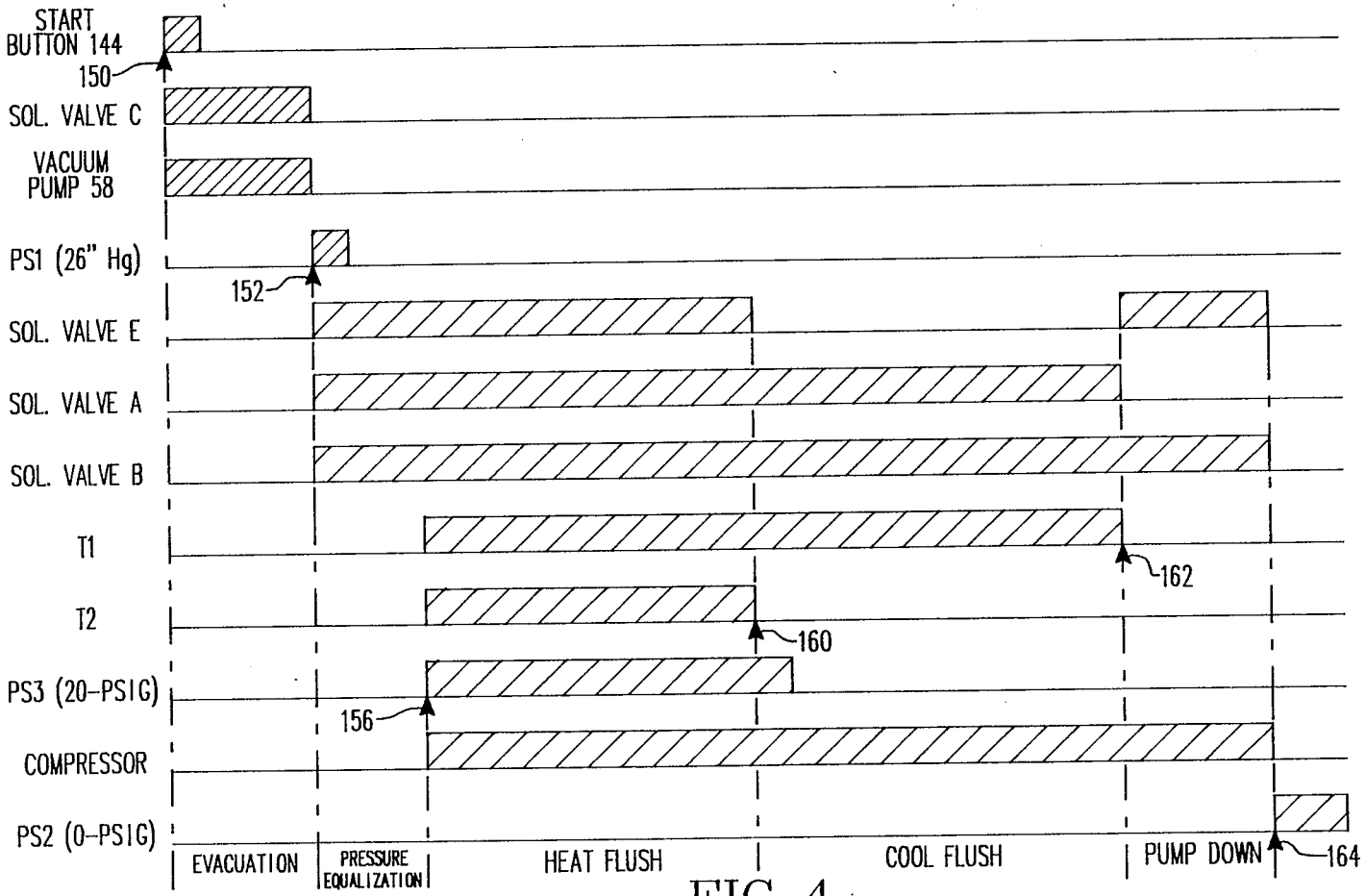
FIG. 4 is a timing diagram which sets forth the timing and sequencing of certain of the functions associated with the piping and electrical diagrams.

FIG. 3 is a schematic diagram of control 124 which may be used to operate cleaning apparatus 10 according to the teachings of the invention. FIG. 4 will also be referred to while describing control 124, as it illustrates the relative timing of certain of the functions to be described.

Control 124 requires a source 126 of alternating potential, to which condenser fan motor 24 is connected via breaker 128 and a contactor MS3. Compressor motor 17 is connected to source 126 via a contactor MS1 and breaker 128, and the vacuum pump motor 59 is connected to source 126 via a contactor MS2 and breaker 128. A control voltage power supply 130 comprising a step down transformer 132 and a rectifier 134 provides a control voltage for a pair of conductors 136 and 138.

The cleaning process is started when a start button 144 is actuated, energizing a cycle start relay R1 via a stop button 146 and normally closed contact R4-1 of a cycle termination relay R4. Contact R1-1 seals in around start button 144 to maintain energization of relay R1 and to energize a conductor 148. Conductor 148 simultaneously energizes solenoid valve C and contactor MS2 via a normally closed contact R3-2 of a vacuum cycle relay R3. Contactor MS2 energizes vacuum pump motor 59, and valve C opens to connect line 60 of the vacuum circuit 14 to refrigeration apparatus 15, which will be assumed to be refrigeration unit 70 shown in FIG. 2. This is set forth in the timing diagram of FIG. 4, with arrow 150 indicating the initial actuation of start button 144. This initial evacuation of refrigeration unit 70 is necessary in order to prevent contaminating refrigerant 28 with air.

The evacuation of unit 70 continues until pressure switch PS1 detects a vacuum of 26 inches of $H_g$, for example, indicated by arrow 152 in FIG. 4. When pressure switch PS1 closes its contact, vacuum cycle relay R3 is energized which opens contact R3-2 to terminate the vacuum portion of the cycle, and it closes a contact R3-1 around pressure switch PS1, to maintain energization of relay R3 and to energize a conductor 154. Conductor 154 energizes solenoids A, B and E. Solenoids A and B open to connect unit 70 to the refrigeration circuit 12 of the cleaning apparatus 10, and solenoid valve E opens to switch three-way valve 78 of unit 70 to the heating mode.

There is now a delay for pressure equalization to occur, so compressor 16 will not start pumping in a vacuum. Pressure switch PS3 indicates the desired pressure equalization has occurred when it detects a pressure of 20 PSIG, for example, as indicated by arrow 156. When pressure switch PS3 closes its contact, a flushing cycle relay R5 is energized which closes its contact R5-1 to seal in relay R5, it closes a contact R5-2 to energize contactor MS1 and start compressor motor 17, and a contact R5-3 opens to start the timing periods of a pair of timers T1 and T2. Timer T1 controls a heat/cool flush cycle, and timer T2 controls when the flushing cycle changes from heat to cool.

Compressor 16 forces high pressure liquid refrigerant 28 through the heating mode output 83 of three-way valve 78, through the defrost pan heater 110, evaporator coil 96, heat exchanger 94, and accumulator 98. Leak tests may now be performed on this heating mode circuit, using a refrigerant detector 158, as illustrated in FIG. 1. This flushing of the heating mode circuit continues for the time preset on timer T2.

When timer T2 times out, indicated by arrow 160 in FIG. 4, it energizes a relay TD2 which opens a contact TD2-1 to de-energize solenoid valve E and cause three-way valve 78 to switch to the cooling mode position.

In the cooling mode position, compressor 16 pumps high pressure liquid refrigerant 28 through the cooling mode output 81 of three-way valve 78, through condenser 82, receiver 84, strainer 122, heat exchanger 94, expansion valve 90, evaporator coil 96, heat exchanger 94, and accumulator 98. Leak tests on these components may be conducted at this time, using refrigerant detector 158. This flushing of the cooling mode path continues until timer T1 times out, indicated by arrow 162 in FIG. 4.

When timer T1 times out, it energizes a relay TD1 which closes a contact TD1-1 to energize a pump down relay R2. Pump down relay R2 closes a seal-in contact R2-3, to initiate a pump down phase of the cleaning cycle, in which refrigerant in unit 70 is returned to storage tank 33. Pump down time can be shortened by switching three-way switch 78 to the heating mode position, and a contact R2-1 accordingly closes to energize solenoid valve E to switch three-way valve 78 to the heating mode position. Contact R2-2 opens to de-energize and thus close solenoid valve A. Pump down is completed when pressure switch PS2 detects 0 PSIG, indicated by arrow 164. When PS2 closes its contact it energizes a relay R4 which opens its contact R4-1 to de-energize relay R1. Contact R1-1 of relay R1 thus opens to de-energize conductor 148, which in turn de-energizes the control devices connected thereto, including solenoid valves E and B, contactor MS1 and compressor motor 17.

Pump down can be initiated at any time by actuating pump down push buttons 166 or 167, and the cleaning process can be stopped at any time by actuating the stop button 146. Compressor 16 may have an unloader valve operated by solenoid F when pressure switch PS4 reaches a predetermined head pressure, such as 350 PSIG, resetting at a predetermined pressure, such as 300 PSIG. Solenoid valve D may be actuated via a manual switch 168, and vacuum pump motor 59 may be started with a manual switch (not shown), for maintenance purposes, during the changing of filter cartridges in the discharge and suction filter driers 26 and 54, respectively.

When refrigeration unit 70 has been cleaned with the apparatus and methods of the invention, strainer 122 is removed and replaced by drier 92, feeler bulb 100 is reattached to the output conduit 97 of evaporator 96, line 112 is reconnected to three-way valve 78, and the hot gas and suction lines 80 and 104 are reconnected to the discharge and suction service valves 74 and 76, respectively. Unit 70 may now be tested without first running for a period of time with a suction filter, permitting test procedures to be started without this delay. Evacuation for refrigerant charging may be performed on unit 70 in less than one-half of the time normally required, because most of the moisture has already been removed. The filters on unit 70 do not have to be taken off and replaced after test, because they will not be contaminated by the clean system. Normal leak testing during unit test need not be performed, as the unit will have already been thoroughly leak tested during flushing with high pressure refrigerant.

I claim:

1. A method of cleaning refrigeration apparatus after manufacture thereof and before charging the apparatus with a refrigerant, with the refrigeration apparatus including suction and hot gas lines suitable for connection to a refrigerant compressor following the cleaning of the refrigeration apparatus, comprising the steps of:

providing cleaning apparatus having vacuum and refrigerant circuits, with the refrigerant circuit including a compressor, a condenser, a first tank having an input and an output, with the first tank containing a supply of high pressure liquid refrigerant, and a second tank having an input and an output, connecting the refrigeration apparatus in the vacuum circuit of the cleaning apparatus, evacuating the refrigeration apparatus to a predetermined pressure to remove air therefrom, connecting both the hot gas line and the suction line of the refrigeration apparatus in the refrigerant circuit of the cleaning apparatus such that the refrigeration apparatus is connected between the first and second tanks, with the output of the first tank being connected to the hot gas line and with the suction line being connected to the input of the second tank, operating the compressor of the cleaning apparatus to force high pressure liquid refrigerant from the first tank through the refrigeration apparatus to the second tank, to remove contaminants from the refrigeration apparatus via the high pressure liquid refrigerant, separating contaminants from the refrigerant in the second tank, vaporizing the refrigerant in the second tank, returning vaporized refrigerant from the second tank to the compressor to continue the operating step, repeating the steps of operating, separating, vaporizing, and returning for a predetermined period of time selected to assure cleansing of the refrigeration apparatus being cleaned, and recovering any refrigerant remaining in the refrigeration apparatus at the end of the predetermined period of time by transferring refrigerant from the refrigeration apparatus to the cleaning apparatus.

2. The method of claim 1 including the step of checking the refrigeration apparatus for refrigerant leaks prior to the step of recovering refrigerant from the refrigeration apparatus.

3. The method of claim 1 including the step of condensing refrigerant in the condenser, to remove heat and liquify the refrigerant, and wherein the step of vaporizing the refrigerant in the second tank includes the step of using heat removed from the refrigerant by the condensing step.

4. The method of claim 1 wherein the refrigeration apparatus is a refrigeration unit which normally includes a compressor, condenser, and evaporator, with the step of connecting the refrigeration apparatus to the cleaning apparatus including the step of substituting the cleaning apparatus for the compressor of the refrigeration unit.

5. The method of claim 4 wherein the refrigeration unit includes valve means operable to select first and second refrigeration paths which provide heating and cooling modes, respectively, and including the step of actuating the valve means during the step of operating the compressor to sequentially force refrigerant through both the first and second paths of the refrigeration unit, to subject both the evaporator and condenser of the refrigeration unit to high pressure refrigerant.

6. The method of claim 5 wherein the step of recovering refrigerant from the refrigeration apparatus includes the step of actuating the valve means to select the heating mode of the refrigeration unit.

7. The method of claim 1 wherein the step of separating contaminants from the refrigerant in the second tank includes the step of passing the refrigerant through compressor oil.

8. The method of claim 1 including the steps of providing the compressor of the cleaning apparatus with an unloader valve, detecting the head pressure of the compressor, and unloading the compressor via the unloader valve when the head pressure reaches a predetermined value.

9. The method of claim 1 including the step of removing compressor oil from the refrigerant following compression of the refrigerant by the compressor of the cleaning apparatus, and returning the removed compressor oil to the compressor.

10. The method of claim 1 including the step of providing filters and driers in the refrigerant circuit of the cleaning apparatus to remove contaminants and moisture from the refrigerant not removed by the separating step.

* * * * *